US005991145A

United States Patent [19]

Lagrotta et al.

[11] Patent Number: 5,991,145

[45] Date of Patent: Nov. 23, 1999

[54] ESD SYSTEM

[75] Inventors: James T. Lagrotta, Boonton; Richard T. Lagrotta, Livingston, both of N.J.

[73] Assignee: Lucent Technologies Inc., Murray Hill, N.J.

[21] Appl. No.: 09/138,791

[22] Filed: Aug. 24, 1998

[51] Int. Cl.[6] ..... H05F 3/00

[52] U.S. Cl. ..... 361/212; 361/220

[58] Field of Search ..... 361/212, 213, 361/216, 220, 223, 224, 225, 229, 230, 235; 340/649

[56] References Cited

U.S. PATENT DOCUMENTS

| | | | |
|---|---|---|---|
| 4,745,519 | 5/1988 | Breidegam . | |
| 4,800,374 | 1/1989 | Jacobson . | |
| 4,859,992 | 8/1989 | Holgaard . | |
| 5,247,420 | 9/1993 | Bakkoum . | |
| 5,519,384 | 5/1996 | Chanudet . | |
| 5,623,255 | 4/1997 | Yang . | |
| 5,666,106 | 9/1997 | Nasman | 361/212 |

OTHER PUBLICATIONS

Sony Corporation "FIU Internal Features" (downloaded from www.sony.com) no date provided.

*Primary Examiner*—Fritz Fleming

[57] ABSTRACT

An EDS tester is combined with an employee identifier and recording monitor so as to provide and audit trail of compliance with the fact of ESD testing and, if desired, a record of the ESD test results such as body resistance or charge. In one illustrative embodiment, a fingerprint identifier pad is used together with the ESD test to identify a unique biological characteristic of the worker being tested. In addition, the feature of providing physical contact with the workers body typically required for ESD testing may be combined with the fingerprint identifier pad thereby enabling the ESD test results to be correlated with a specific individual.

8 Claims, 1 Drawing Sheet

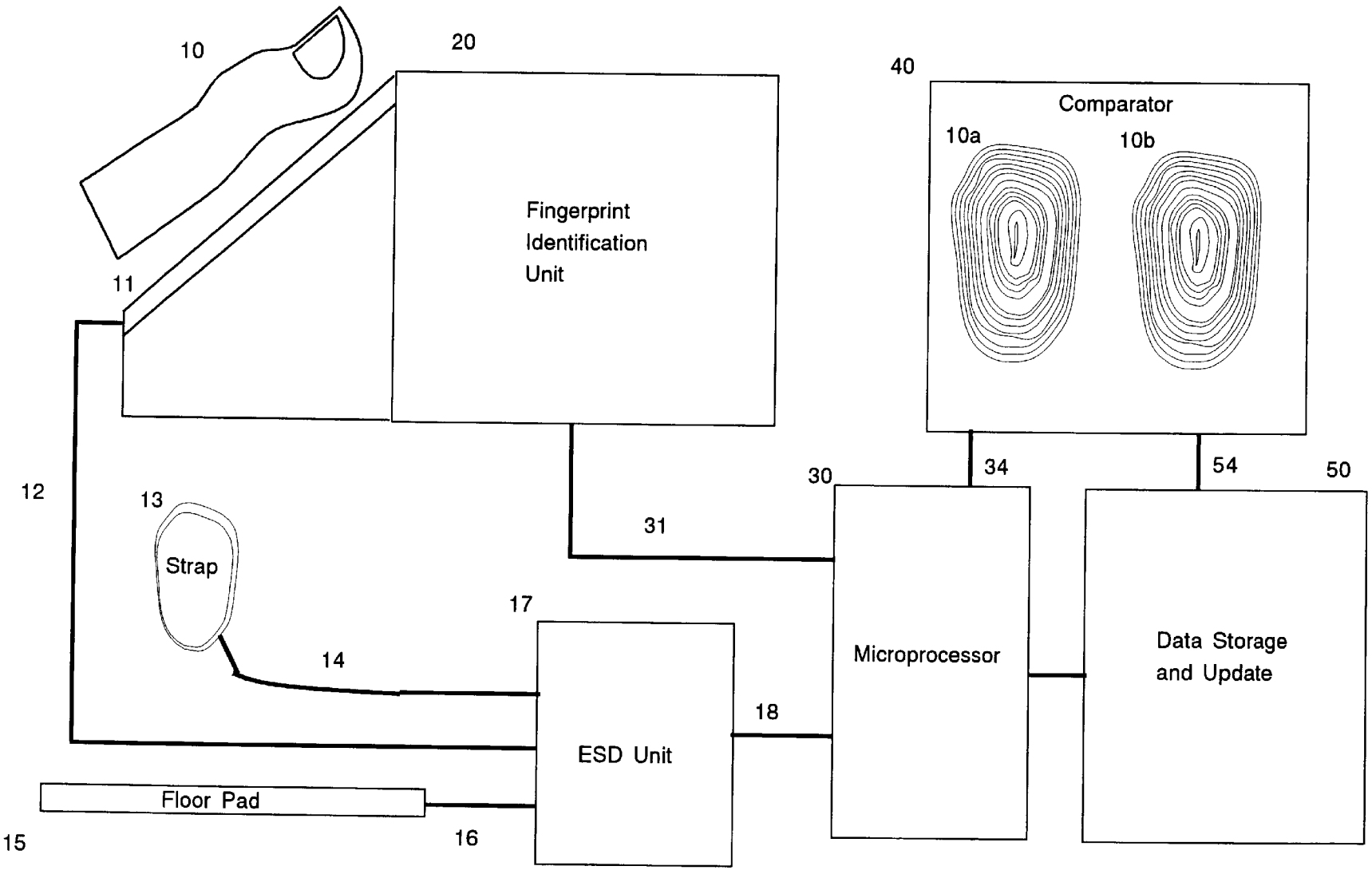
Comparator
10a
10b
40
Data Storage and Update
50
54
Microprocessor
34
30
Fingerprint Identification Unit
20
31
ESD Unit
18
17
Floor Pad
16
15
Strap
13
14
10
11
12

ESD SYSTEM

FIELD OF THE INVENTION

This invention relates to electrostatic discharge systems and more particularly to such systems.

BACKGROUND OF THE INVENTION

In many high technology manufacturing operations, such as those involving the production of metal oxide silicon (MOS) transistor circuits, it is essential that plant personnel carefully observe rules requiring them to rid themselves of all static electric charges. In a typical manufacturing plant, employees may be required to test their ESD overshoes and log the results of the test every time they enter and leave their work area. Unfortunately, this task takes time, employees are sometimes lax in complying and some consider the task onerous and intrusive.

A number of prior art patents have addressed the problem of discharging static electricity accumulation. For example, U.S. Pat. No. 5,632,255 discloses a testing wristlet seat which uses an oscillator circuit to test a test lead which is grounded to discharge the static electricity produced in a manufacturing procedure. The oscillator generates a frequency to sound an alarm when the user breaks the ground connection. In U.S. Pat. No. 5,519,384 the worker wears a conductive wrist strap, circuitry monitors the electric field at the operator's wrist, sounds a warning and records when a problems occurs. In U.S. Pat. No. 5,247,420 a voltage-controlled oscillator senses the voltage on a discharge capacitor, generates high voltage pulses the effect the removal of charge by means of air ionization. In U.S. Pat. No. 4,859,992 the integrity of ground connections to conductive workbench, floor mats and wrist straps are monitored and alarms are generated when the resistance to ground approaches a set value. In U.S. Pat. No. 4,800,374 conductive wrist bands, touch pads and shoe plates are monitored for resistance and indicator lights provide a display of whether a safe or hazardous condition exists. U.S. Pat. No. 4,745,519 discloses details of a stretchable wrist strap having two or more sections of conductive material and circuitry for monitoring whether any of the sections of conductive material are in contact with the wearer or if the connection to ground is broken.

While all of the foregoing devices operate satisfactorily, they are not quite adequate to assure, in a commercial environment, the ideal standard of conduct to which Paracelsus may have had in mind when he uttered the timeless words. "That we devote ourselves to God, is seen In living just as through no God there were". Simply stated, the prior art devices operate anonymously and therefore do not accommodate the requirements of management for assurance that each individual worker remain in compliance with ESD standards. In short, an identifiable audit trail of ESD compliance is required.

SUMMARY OF THE INVENTION

In accordance with the principles of the present invention an ESD tester is combined with an employee identifier and recording monitor. For example, in one illustrate embodiment, the prior art conductive touch pad is replaced by a fingerprint identifier pad to combine the features of physical contact with the workers body typically required for ESD testing with an identification of a unique biological characteristic of the worker being tested, thereby enabling the ESD test results to be correlated with a specific individual. The correlation method could comprise: capturing a personal identification image such as a fingerprint directly from the operator, substantially imultaneously capturing appropriate resistivity or electric field intensity ESD test data; comparing the image data with stored worker data; comparing the ESD test data with stored criteria and recording the results of the comparisons.

BRIEF DESCRIPTION OF THE DRAWING

The foregoing objects may become more apparent from of reading of the ensuing description together with the drawing, the single FIGURE of which shows an illustrative embodiment of an ESD System according to the invention.

DETAILED DESCRIPTION

Referring now to the single FIGURE of the drawing, a conventional ESD unit 17 may include inputs from a worker's wrist strap 13 and pigtail lead 14 and/or a conductive floor pad 15 and associated input lead 16. Over lead 18, the ESD unit may record the results of its electrostatic charge measurement or body resistance tests in an associated computer or microprocessor 30. However, in accordance with the principles of out invention, at the same time that the ESD unit is acquiring its information from the worker, an associated fingerprint identification unit 20 is called into operation by the worker placing the finger 10 on its scanning platen, sometimes referred to in the art as a "biometric sensor". The biometric sensor overcomes the possibility that a wax image of fingerprint could be used in an attempt to fool the FIU. One well-known FIU device is manufactured and sold by Sony. The fingerprint identification unit 20 sends data from the image of the scanned fingerprint 10*a* to microprocessor 30 over lead 31.

Prior to actual deployment and during the conventional enrollment process, the data storage and update unit 50 associated with the FIU will normally have been loaded with the fingerprints, such as fingerprint 10*b*, of each of its employees. When the worker now places his finger on the scanning platen, the scanned image of his fingerprint 10*a* acquired by microprocessor 30 is sent over lead 34 and compared in comparator 40 with all of the stored images accessed from data storage and update unit 50 via lead 54. In typically less than a second, a match may be made. When a match occurs between a scanned image 10*a* and a stored image 10*b*, the results of the comparison, as well as the data obtained by the ESD unit 17 are entered into the data storage and update unit 50 thereby providing an "audit trail" of the ESD test which identifies the employee taking the test.

Typically, the FIU only captures a sampling of the fingerprint and does not store an image of the entire fingerprint. This helps reduce the stored template size, increases speed, and protects the user by avoiding potential security problems. The image may be stored in the associated microprocessor or computer as a template or sent to a central processing unit (not shown).

Further in accordance with our invention, the platen 11 of the FIU may be made of conductive, transparent plastic or, equally advantageously, conductive strips may be incorporated on or closely adjacent to the platen. The conductive platen or stripes are connected via lead 12 to an input of the ESD unit 17 so that electrical resistance of the finger or its electrostatic charge may be measured by the ESD unit.

What has been disclosed is deemed to be illustrative of the principles of our invention. For example, comparator 40 has been shown as a separate hardware device. However, it should be understood that such comparisons may be made entirely in software withing microprocessor 30 and, indeed, microprocessor 30 or many of its functions and/or those of ESD 17, may be packaged together with those of FIU 20. Further and other changes may be made by those skilled in the art without, however, departing from the spirit and scope of our invention.

What is claimed is:

1. An electrostatic testing device comprising:

a) a fingerprint identification unit;

b) an electrostatic testing unit; and c) a microprocessor for associating the output of the fingerprint identification unit with the output of the electrostatic testing unit.

2. An electrostatic testing device comprising:

a) a fingerprint identification unit;

b) an electrostatic testing unit; and c) a microprocessor controlled data storage unit for associating the output of the fingerprint identification unit with the output of the electrostatic testing unit.

3. An electrical testing and monitoring system, comprising:

a) a biometric sensor for ascertaining the particularized identity of a person;

b) apparatus for performing an electrical test on the person; and c) apparatus for associating the output of said biometric sensor with the output of said apparatus for performing said electrical test.

4. An electrical testing and monitoring system according to claim 3 wherein said electrical test is an electrostatic discharge test.

5. An electrical testing and monitoring system according to claim 4 wherein the apparatus for associating the output of the biometric sensor with the output of said apparatus for performing said electrostatic discharge test includes a microprocessor controlled data storage unit for comparing a plurality of fingerprints with the output of said biometric sensor and for recording the results of said comparison with the results of said electrostatic discharge test.

6. An electrical testing and monitoring system, comprising:

a) a biometric sensor providing an output for ascertaining the fingerprint identity of a person;

b) apparatus for performing an electrical test on the person; and c) apparatus for associating the output of said biometric sensor with the output of said apparatus for performing said electrical test on said person.

7. A method of providing an audit trail of electrostatic discharge (ESD) tests, comprising the steps of:

a) obtaining a biometric sample ascertaining the particularized identity of the person undergoing an ESD test; and b) recording the results of the ESD test together with said biometric sample.

8. A method according to claim 7, wherein the biometric sample is a fingerprint; and wherein the electrostatic test tests the electrical resistance of the finger providing the fingerprint.

* * * * *